US009038479B2

(12) United States Patent
Langer

(10) Patent No.: US 9,038,479 B2
(45) Date of Patent: May 26, 2015

(54) COMPRESSION FITTING

(75) Inventor: Alexander Langer, Wallingford, CT (US)

(73) Assignee: United Technologies Corporation, Hartford, CT (US)

( * ) Notice: Subject to any disclaimer, the term of this patent is extended or adjusted under 35 U.S.C. 154(b) by 326 days.

(21) Appl. No.: 13/560,656

(22) Filed: Jul. 27, 2012

(65) Prior Publication Data

US 2014/0028020 A1 Jan. 30, 2014

(51) Int. Cl.
*F01D 17/08* (2006.01)

(52) U.S. Cl.
CPC ..... *F01D 17/08* (2013.01); *F01D 17/085* (2013.01)

(58) Field of Classification Search
CPC ..... F01D 17/02; F01D 17/08; F01D 17/085; F02C 9/00
USPC ..... 285/253, 353; 439/306–309, 320–323; 73/856, 431
See application file for complete search history.

(56) References Cited

U.S. PATENT DOCUMENTS

| | | | | | |
|---|---|---|---|---|---|
| 3,720,419 | A * | 3/1973 | Adelizzi | 277/413 |
| 4,354,723 | A * | 10/1982 | Lee | 439/462 |
| 4,595,251 | A * | 6/1986 | Moulin | 439/289 |
| 5,011,426 | A | 4/1991 | Colleran | |
| 5,548,119 | A | 8/1996 | Nortier | |
| 5,560,841 | A * | 10/1996 | DeMichael et al. | 219/85.1 |
| 5,682,002 | A | 10/1997 | Marder | |
| 5,921,683 | A * | 7/1999 | Merritt et al. | 384/106 |
| 6,368,133 | B1 * | 4/2002 | Zeiler et al. | 439/321 |
| 6,609,924 | B2 * | 8/2003 | Zeiler et al. | 439/321 |
| 6,666,726 | B2 * | 12/2003 | Koch | 439/680 |
| 6,788,054 | B2 | 9/2004 | Collins | |
| 6,978,754 | B2 | 12/2005 | Cicone | |
| 7,204,709 | B2 | 4/2007 | Justice | |
| 7,374,508 | B2 | 5/2008 | Duncan | |
| 2002/0037660 | A1 * | 3/2002 | Koch | 439/320 |
| 2004/0038578 | A1 * | 2/2004 | Weigel et al. | 439/320 |
| 2006/0172580 | A1 * | 8/2006 | Scholler et al. | 439/321 |
| 2008/0202235 | A1 | 8/2008 | Laps | |
| 2010/0151717 | A1 * | 6/2010 | Bulow | 439/321 |
| 2011/0088834 | A1 * | 4/2011 | Miyamoto et al. | 156/191 |
| 2011/0130246 | A1 | 6/2011 | McCune et al. | |
| 2011/0239660 | A1 | 10/2011 | Suciu et al. | |
| 2011/0312199 | A1 * | 12/2011 | Alrutz et al. | 439/188 |
| 2012/0171382 | A1 * | 7/2012 | Mullin et al. | 427/294 |

* cited by examiner

*Primary Examiner* — Lisa Caputo
*Assistant Examiner* — Philip Cotey
(74) *Attorney, Agent, or Firm* — O'Shea Getz P.C.

(57) ABSTRACT

A compression fitting includes a housing, a compressible seal, a follower and a driving member. The housing includes an axial cavity having a lateral sidewall that includes an axial keyway therein. The cavity terminates at a first end portion thereof at a seat. The compressible seal may receive a signal transmitting lead therethrough, and is disposed within the cavity and seated on the seat. The follower is axially movable within the cavity for selective engagement with the seal for axially compressing the seal against the seat, the sidewall of the cavity and the signal transmitting lead. The follower includes an integral key that extends laterally outward therefrom and is received within the keyway, and an axial bore for accommodation therewithin of the lead. The driving member is rotatably mounted on the housing and engageable with the follower such that rotation of the driving member causes an axial translation thereof.

20 Claims, 1 Drawing Sheet

COMPRESSION FITTING

BACKGROUND OF THE INVENTION

1. Technical Field

The present invention relates to compression fittings and more particularly to a compression fitting for mounting a sensor such as a thermoelectric or fluid mechanical sensor to an apparatus such as a gas turbine engine.

2. Background Information

Apparatus such as gas turbine engines which power aircraft and industrial equipment are typically instrumented for monitoring and controlling the engine's operation. For example, modern gas turbine engines are typically provided with a plurality of sensors such as thermocouples or other thermoelectric sensors which measure operating temperatures at various locations within an engine, pressure sensors which measure the pressure of working fluid at various locations within the engine and accelerometers which measure the vibration of mechanical components within the engine. Sensors such as the above noted thermocouples, pressure sensors and accelerometers usually include leads which transmit a signal indicative of the operating condition being measured to signal processing apparatus which may display the signal in a readable form to an operator of the engine or control the operation of the engine in response to the signal. In the case of electric sensors such as thermocouples and accelerometers, such leads are typically thin electrical conductors such as wires. In the case of fluid-mechanical sensors such as pressure sensors and the like, such leads are typically thin tubes which extend from the sensor to the signal processing apparatus such as the display apparatus or engine controller noted above. Sensor leads such as the above noted electrical and fluid mechanical wires and tubes are typically egress the engine through a sealed fitting which provides a pathway for the extension of the sensor leads to the signal processing apparatus. It will be appreciated that such sensor fittings must include a seal for preventing leakage of working fluid within the engine through the fitting to the engine's surroundings. Known sensor fittings include a body or housing through which the leads extend and a mechanical means for compressing the seal against the leads and the interior of the housing. Such mechanical seal compression means often take the form of a rotationally driven piston or follower through which the leads extend, interiorally of the fitting body. To prevent twisting or torque shearing of the leads extending through the follower, the follower must axially translate within the fitting body without rotation. Thus, it has been the practice to provide such sensor fittings with a small anti-rotation pin which engages the follower and fitting body to prevent rotation of the follower as it translates axially through the fitting body in compressing the fitting seal. It has been observed that in the assembly of the sensor fitting with the host engine, such small anti-rotation pins are often inadvertently omitted from the sensor fitting, thereby allowing the follower to rotate as it is moved axially to compress the seal material within the fitting, thus damaging or severing the leads extending through the follower. It has also been observed that such small anti rotation pins may separate from the fitting, to be ingested by the engine, thereby damaging critical rotational and stationary engine components such as blades, seals and the like.

Thus, there is a need for a fitting, by which provides a sealed egress for electrical or fluid mechanical sensor leads is from an apparatus such as a gas turbine engine, which prevents damage to the sensor leads extending through the fitting as seal material within the fitting is compressed against the sensor leads and the interior of the fitting's housing without the use of separate anti rotation parts such as the small anti-rotation pins noted above, which are often inadvertently omitted from of the fitting assembly or separated therefrom and ingested into the apparatus on which the fitting is used.

SUMMARY OF THE DISCLOSURE

It is a primary object of the present invention to provide a sensor fitting for an apparatus such as a gas turbine engine, which does not rely on a component separate from that which compresses seal material within the fitting to prevent rotation of such seal compressing component and the attendant damage to sensor leads within the fitting from such rotation of the seal compressing component.

In accordance with the present invention, a compression fitting for a sensor for measuring an operating parameter of an apparatus such as a gas turbine engine includes a housing or body having an elongate axial cavity therethrough and a compressible seal seated at one end of the axial cavity, the seal being compressible against the cavity sidewall and signal transmitting leads extending through the fitting from a sensor, by a follower disposed within the cavity and axially movable with respect thereto, the follower being provided with an integral anti rotation key extending outwardly therefrom and received within a keyway provided in the axial cavity of the housing. A rotational driving member disposed at an end portion of the housing engages the follower such that rotation of the driving member causes an axial translation thereof, thereby axially translating the follower within the cavity. The follower's anti-rotation key is rotatably constrained within the keyway thereby preventing rotation of the follower as the driving member translates the follower along the axial passage, and any attendant damage to the sensor leads within the follower due to such follower rotation.

In an additional or alternative embodiment of the foregoing, the housing is threaded at an end portion thereof and the driving member includes an internally threaded nut adapted to receive the sensor leads therethrough, the nut being in threaded engagement with the threaded end portion of the housing. In another additional embodiment of the foregoing, the threaded nut comprises a cap nut including an opening in an end thereof adapted to receive the sensor leads therethrough. In an additional embodiment, the opposite end of the housing is externally threaded for a threaded engagement with the apparatus in which the sensor is installed. In another alternative embodiment of the foregoing, the fitting's seal is formed from a compressible elastomeric material and/or a compressible metallic material such as a honeycomb seal. In a further embodiment of the present invention the seat includes a concave end surface and the seal includes a concave end surface conforming to and seated on the concave end surface of the seat. In yet another alternative embodiment of the foregoing, the keyway is generally rectilinear and opens to that end of the housing on which the rotational driving member is mounted, the follower key conforming generally in cross section to the keyway. In another additional embodiment of the foregoing, the follower and housing cavity are generally cylindrical, the follower comprising a piston conforming in cross section to the cylindrical cross section of the cavity. In still another additional embodiment of the foregoing, the driving member engages the follower in abutment therewith. In yet another additional embodiment of the foregoing, the follower is provided with a plurality of bores, each accommodating an individual signal transmitting lead therethrough, the follower being provided with an opening therein at the end thereof at which said follower engages the rotational driving member, each of the plurality of axial bores extending through the follower and communicating with the opening in the follower end. In other additional or alternative embodiments of any of the foregoing embodiments, the signal transmitting leads may be electrical conductors such as wires for transmitting electrical signals from an electrical sensor such as a thermoelectric temperature sensor (thermocouple) or an electrical vibration sensor such as an accelerometer. In additional embodiments of the foregoing embodiments, the signal transmitting leads may be tubes for transmitting a fluid mechanical pressure signal from a fluid mechanical sensor such as a pressure sensor.

DETAILED DESCRIPTION OF THE INVENTION

Figure 1:
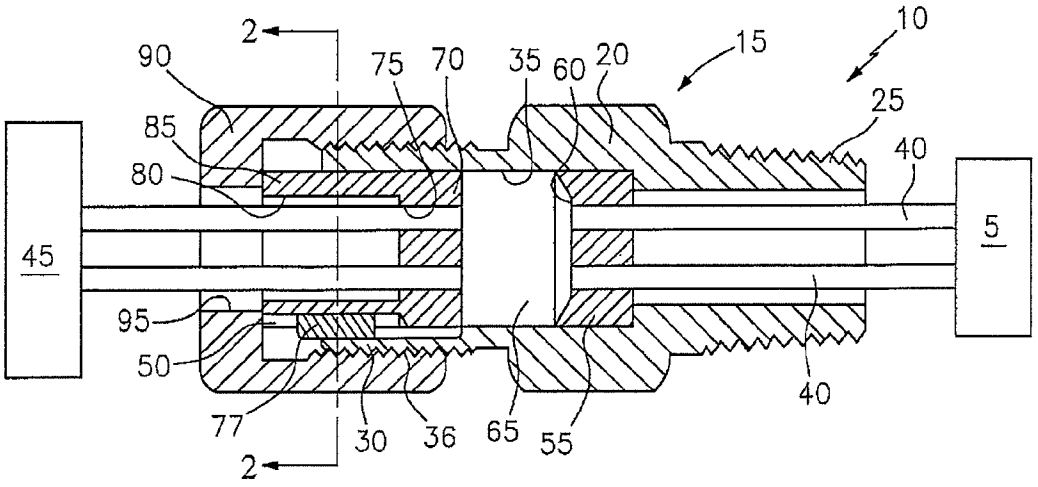
FIG. 1 is a partially sectioned side elevation of the compression fitting of the present invention.
Figure 2:
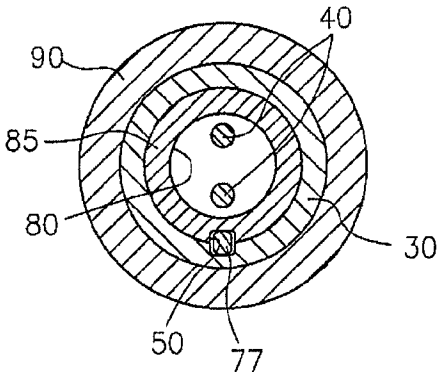
FIG. 2 is a sectional view of the compression fitting of the present invention taken along the line 2-2 of FIG. 1.

Referring to the drawings a sensor 5 is disposed within an apparatus such as a gas turbine engine 10 for measuring an operating parameter thereof such as temperature or pressure of working fluid flowing therewithin or vibration of a component thereof. A fitting 15 of the present invention mounts to the apparatus 10 and includes a housing or body portion 20 externally threaded at a first end portion 25 thereof, the threads on the body engaging mating threads on a housing or enclosure of apparatus 10 for firmly mounting the fitting thereon. A second end portion 30 of body 20 is externally threaded at 36. Body 20 also includes a generally cylindrical axial cavity 35 extending through body 20 between the first and second ends thereof. Axial cavity 35 accommodates therethrough, axially extending signal carrying leads 40 which connect to sensor 5 to provide signals therefrom to signal processing apparatus 45 which processes signals carried by leads 40 for display of the signals to an operator of apparatus 10 or for use by a controller (not shown) for controlling apparatus 10. Sensor 5 may be any known type of sensor such as any of various electrical sensors such as a thermoelectric sensor such as a thermocouple or an electrical sensor such as an accelerometer. Sensor 5 may also be a fluid mechanical sensor such as a pressure sensor or equivalent thereof for measuring fluid pressure of working fluid flowing through apparatus 10. Where sensor 5 is an electrical sensor, leads 40 are electrical conductors such as wires. Where the operating parameter measured by sensor 5 is a fluid mechanical parameter such as working fluid pressures within a gas turbine engine, leads 40 may be tubes for transmitting a fluid mechanical signal to signal processing apparatus 45.

Axial cavity 35 includes an elongate axial keyway 50 in the lateral sidewall thereof opening to second end 30 of body 20 and accommodates a seat 55 at an inner end of the cavity. Seat 55 includes a concave endwall 60 on which a conforming convex endwall of a seal 65 is seated. As illustrated in FIG. 1, seal 65 accommodates leads 40 therethrough. Seal 65 is formed from any suitable compressible material compatible with the operational environment of the fitting of the present invention. For example, in low temperature environments, seal 65 may be formed from an elastomeric material such as any of various known synthetic rubbers or the like. In high temperature environments such as those encountered in gas turbine engines, seal 65 may be formed from a metallic material such as a relatively soft compressible metallic material such as lead or a harder metallic material formed in a honeycomb.

Seal 65 is compressed into sealing engagement with seat 55, first end portion of axial cavity 35 and signal transmitting leads 40 by piston or follower 70 which is rectilinearly movable in an axial direction within axial cavity 35. Follower 70 is generally cylindrical in cross section, conforming to the cylindrical shape of axial cavity 35 and includes an integral anti-rotation key 77, which conforms generally to keyway 50, being slidably received therewithin and extending outwardly from follower 70. Follower 70 also includes a plurality of axial bores 75 which accommodate axial extensions of leads 40 therewithin. Bores 75 extend from a first end of follower 70 which engages seal 65, axially through opening 80 in an opposite end 85 of follower 70 for continuous extension to signal processing apparatus 45. Follower 70 is rectilinearly movable in an axial direction for compression of seal 65 by an internally threaded cap nut 90 threaded onto threads 32 of second end 30 of housing 20. As shown in FIG. 1, cap nut 90 abuts second end 85 of follower 70 at an interior surface of the cap nut such that follower 70 slides toward seal 65 for compressive engagement therewith as the cap nut is rotated on threads 36 of housing 20. Cap nut 90 includes an opening 95 in an end thereof to accommodate the extension of leads 40 therethrough for ultimate connection to signal processing apparatus 45. Key 77 prevents rotation of follower 70 by cap nut 90 as cap nut 90 is rotated on threads 36.

Anti-rotation key 77 may be machined or cast into follower 70 or formed separately therefrom and attached thereto as by welding, brazing or the like or mechanical attachment thereto by threaded engagement, press-fitting or equivalent attachment schemes. Thus, it will be seen that key 77 rotationally constrains follower 70 as follower 70 axially translates within axial passage 35 as cap nut 90 is rotated. Such rotational constraint ensures that leads 40 will not be twisted, damaged or otherwise compromised by unwanted rotation of follower 70 as it translates within axial cavity 35.

While a specific embodiment of the present invention has been shown and described herein, it will be understood that various modifications of this embodiment may suggest themselves to those skilled in the art. For example, while specific shapes and configuration of the components of the present invention have been illustrated and described, it will be apparent that various other shapes and configurations may be employed with equal utility. Thus, while the driving member has been shown and described as a cap nut, it will be apparent that other equivalent rotational driving members may be employed. Similarly, while axial cavity 35 and conforming follower 70 have been illustrated and described as being cylindrical, it will be apparent that various other cross sectional shapes may be employed without departing from the present invention. While follower 70 has been illustrated and described as having a single anti-rotation key, it will be understood that a plurality of anti-rotation keys each disposed within a single keyway may be employed. Additionally, the anti-rotation keys may be semi-integrated with the follower by attachment thereto by a threaded engagement or equivalent mechanical attachment (as by welding, brazing or the like) thereto. The antirotation keys may also be attached to the follower by press fitting thereto. Furthermore, while specific materials for seal 65 have been described, it will be apparent that various other materials compatible with the operating environment of the fitting of the present invention may be employed without departure therefrom. Also, while the invention herein has been shown and described with a single keyway accommodating a single conforming anti rotation key, it will be appreciated that multiple keyways accommodating multiple keys may be employed. Furthermore, while the invention herein has been described within the context of utilization in a gas turbine engine, it will be appreciated by those skilled in the art that the fitting of the present invention is also well adopted for use in any instrumented machinery. Accordingly, it will be understood that these and various other modifications of the preferred embodiment of the present invention as illustrated and described herein may be implemented without departing from the present invention and it is intended by the appended claims to cover these and any other such modifications which fall within the true spirit and scope of the invention herein.

What is claimed is:

1. A compression fitting for a sensor for measuring an operating parameter of an apparatus, said sensor including at least one signal transmitting lead, said compression fitting comprising:

a housing having first and second end portions and an axial cavity having a lateral sidewall including an axial keyway therein and extending through said housing, said cavity terminating at a first end portion thereof, at a seat;

a compressible seal adapted to receive said signal transmitting lead therethrough disposed within said cavity and seated on said seat;

a follower disposed within said cavity and axially movable with respect thereto for selective engagement with said seal for axially compressing said seal against said seat, said sidewall of said cavity and said signal transmitting lead, said follower including at least one integral key extending laterally outwardly therefrom and received within said keyway for axial movement therewithin and at least one axial bore therethrough for accommodation therewithin of said lead; and a driving member disposed at said second end portion of said housing, said driving member being rotatably mounted on said housing and engageable with said follower such that rotation of said driving member causes an axial translation thereof, thereby axially translating said follower within said cavity, said key being rotatably constrained within said keyway for preventing rotation of said follower.

2. The compression fitting of claim 1, wherein said housing is externally threaded at said second end portion and said driving member comprises an internally threaded nut adapted to receive said lead therethrough, in threaded engagement with said threaded second end portion of said housing.

3. The compression fitting of claim 2, wherein said internally threaded nut comprises a cap nut including an opening in an end thereof adapted to receive said lead therethrough.

4. The compression fitting of claim 1, wherein said first end of said housing is externally threaded for a threaded attachment to said apparatus.

5. The compression fitting of claim 1, wherein said signal transmitting lead comprises an electrical conductor for transmitting an electrical signal therethrough.

6. The compression fitting of claim 5, wherein said sensor comprises a thermoelectric sensor.

7. The compression fitting of claim 5, wherein said sensor comprises an accelerometer.

8. The compression fitting of claim 1, wherein said lead comprises a tube for the transmission of a fluid pressure signal therethrough.

9. The compression fitting of claim 8, wherein said sensor comprises a pressure sensor.

10. The compression fitting of claim 1, wherein said seat includes a concave end surface and said compressible seal includes a convex end surface engaged with and conforming to said concave end surface of said seat.

11. The compression fitting of claim 1, wherein said seal comprises a compressible elastomeric material.

12. The compression fitting of claim 1, wherein said seal comprises a compressible metallic material.

13. The compression fitting of claim 12, wherein said compressible metallic material comprises a honeycomb.

14. The compression fitting of claim 1, wherein said keyway is generally axially rectilinear and opens to said second end of said housing.

15. The compression fitting of claim 1, wherein said key conforms generally in cross section to said keyway.

16. The compression fitting of claim 1, wherein said housing cavity is generally cylindrical in shape.

17. The compression fitting of claim 1, wherein said follower comprises a piston generally cylindrical in shape and conforming in cross sectional shape to said cylindrical cavity in said housing.

18. The compression fitting of claim 1, wherein said driving member engages said follower in abutment therewith.

19. The compression fitting of claim 1, wherein said at least one axial bore in said follower comprises a plurality of said axial bores.

20. The compression fitting of claim 19, wherein said follower includes first and second ends, said driving member being engageable with said follower at said first end, said second end being provided with an opening therein, each of said plurality of axial bores extending from said first end of said follower to said opening in said second end thereof.

* * * * *